US010407649B2

(12) United States Patent
Blondel et al.

(10) Patent No.: US 10,407,649 B2
(45) **Date of Patent: *Sep. 10, 2019**

(54) USE IN DETERGENT COMPOSITIONS OF POLYMERS OBTAINED BY LOW-CONCENTRATION REVERSE EMULSION POLYMERIZATION WITH A LOW CONTENT OF NEUTRALIZED MONOMERS

(71) Applicant: S.P.C.M. SA, Andrezieux Boutheon (FR)

(72) Inventors: Frédéric Blondel, Lezigneux (FR); Lionel Champagnon, Magneux Haute Rive (FR)

(73) Assignee: S.P.C.P. SA, Andrezieux Boutheon (FR)

( * ) Notice: Subject to any disclaimer, the term of this patent is extended or adjusted under 35 U.S.C. 154(b) by 74 days.

This patent is subject to a terminal disclaimer.

(21) Appl. No.: 15/500,590

(22) PCT Filed: Aug. 5, 2015

(86) PCT No.: PCT/FR2015/052164

§ 371 (c)(1),
(2) Date: Jan. 31, 2017

(87) PCT Pub. No.: WO2016/020622

PCT Pub. Date: Feb. 11, 2016

(65) Prior Publication Data

US 2017/0218308 A1 Aug. 3, 2017

(30) Foreign Application Priority Data

Aug. 6, 2014 (FR) ..... 14 57660

(51) Int. Cl.
*C11D 3/37* (2006.01)
*C11D 17/00* (2006.01)

(52) U.S. Cl.
CPC ..... *C11D 3/3765* (2013.01); *C11D 17/003* (2013.01); *C11D 17/0008* (2013.01)

(58) Field of Classification Search
CPC ..... C11D 3/37; C11D 3/3757; C11D 3/3769; C11D 3/378
See application file for complete search history.

(56) References Cited

U.S. PATENT DOCUMENTS

| | | | |
|---|---|---|---|
| 2,438,091 | A | 3/1948 | Lynch |
| 2,528,378 | A | 10/1950 | Mannheimer |
| 2,658,072 | A | 11/1953 | Kosmin |
| 3,284,393 | A | 11/1966 | Vanderhoff et al. |
| 3,724,547 | A | 4/1973 | Bott |
| 3,755,560 | A | 8/1973 | Dickert et al. |
| 3,893,929 | A | 7/1975 | Basadur |
| 3,959,230 | A | 5/1976 | Hays |
| 4,116,896 | A | 9/1978 | Garrett et al. |
| 4,421,769 | A | 12/1983 | Dixon et al. |
| 4,539,368 | A | 9/1985 | Duncan et al. |
| 4,597,898 | A | 7/1986 | Vander |
| 4,656,222 | A | 4/1987 | Defazio |
| 4,664,839 | A | 5/1987 | Rieck |
| 4,677,152 | A | 6/1987 | Allen et al. |
| 4,702,857 | A | 10/1987 | Gosselink |
| 4,704,272 | A | 11/1987 | Oh et al. |
| 4,711,730 | A | 12/1987 | Gosselink et al. |
| 4,721,580 | A | 1/1988 | Gosselink |
| 4,741,855 | A | 5/1988 | Grote et al. |
| 4,746,456 | A | 5/1988 | Kud et al. |
| 4,770,666 | A | 9/1988 | Clauss |
| 4,788,006 | A | 11/1988 | Bolich, Jr. et al. |
| 4,877,896 | A | 10/1989 | Maldonado et al. |
| 4,968,451 | A | 11/1990 | Scheibel et al. |
| 5,004,598 | A | 4/1991 | Lochhead et al. |
| 5,011,681 | A | 4/1991 | Ciotti et al. |
| 5,216,070 | A | 6/1993 | Plochocka et al. |
| 5,368,850 | A | 11/1994 | Cauwet et al. |
| 5,380,465 | A | 1/1995 | Baker et al. |
| 5,458,881 | A | 10/1995 | Berger et al. |
| 5,484,843 | A | 1/1996 | Mallo et al. |
| 5,679,656 | A | 10/1997 | Hansenne |

(Continued)

FOREIGN PATENT DOCUMENTS

| | | |
|---|---|---|
| DE | 19523596 | 1/1997 |
| EP | 11 984 | 6/1980 |

(Continued)

OTHER PUBLICATIONS

Jian Fang GE et al., "Investigation on the . . . of Acrylic Acid", Chinese Chemical Letters, vol. 13, No. 10, pp. 993-996, 2002.

*Primary Examiner* — Brian P Mruk

(74) *Attorney, Agent, or Firm* — Heslin Rothenberg Farley & Mesiti P.C.

(57) ABSTRACT

An aqueous liquid detergent composition for household or industrial use, of a branched or cross-linked polymer is obtained by polymerizing an aqueous solution of one or more monomers by water-in-oil reverse emulsion, at least one of the monomers used being an acrylic monomer and one or more of the monomers used being a monomer carrying at least one weak acid function. The molar percentage of monomers carrying at least one weak acid function relative to the totality of the monomers being used being at least 30%, characterized in that:

i) the polymerization is carried out with a concentration of the totality of the monomers in aqueous solution being in the range 1.3 mmol to 3.6 mmol per gram of aqueous solution;

ii) during the polymerization, at most 20% of the acid functions present on the monomers having at least one acid function are in the neutralized form.

24 Claims, No Drawings

(56) References Cited

U.S. PATENT DOCUMENTS

| | | | | |
|---|---|---|---|---|
| 5,928,656 | A | 7/1999 | Chaudhry et al. | |
| 6,024,946 | A | 2/2000 | Dubief et al. | |
| 6,197,287 | B1 | 3/2001 | Mallo et al. | |
| 6,274,539 | B1 | 8/2001 | Kacher et al. | |
| 6,433,061 | B1 * | 8/2002 | Marchant | C08F 220/04 524/460 |
| 6,579,466 | B1 | 6/2003 | David et al. | |
| 7,973,004 | B2 | 7/2011 | Vaynberg | |
| 9,963,532 | B2 * | 5/2018 | Blondel | C08F 2/32 |
| 2003/0147825 | A1 | 8/2003 | Chiarelli et al. | |
| 2004/0028637 | A1 * | 2/2004 | Villard | A61K 8/8158 424/70.16 |
| 2006/0281660 | A1 | 12/2006 | Song et al. | |
| 2007/0265386 | A1 | 11/2007 | Mallo et al. | |
| 2014/0309368 | A1 | 10/2014 | Blondel et al. | |

FOREIGN PATENT DOCUMENTS

| | | |
|---|---|---|
| EP | 0 161 038 | 11/1985 |
| EP | 0 216 479 | 4/1987 |
| EP | 0 503 853 | 9/1992 |
| EP | 0 576 188 | 12/1993 |
| EP | 0 604 249 | 6/1994 |
| EP | 0 759 966 | 11/2002 |
| FR | 2 236 926 | 2/1975 |
| FR | 2 334 698 | 7/1977 |
| FR | 2 744 131 | 8/1997 |
| FR | 2 766 838 | 2/1999 |
| FR | 2 789 395 | 8/2000 |
| FR | 2 979 821 | 3/2013 |
| GB | 2 346 891 | 8/2000 |
| WO | 93/07902 | 4/1993 |
| WO | 94/27561 | 12/1994 |
| WO | 98/09611 | 3/1998 |
| WO | 01/97772 | 12/2001 |
| WO | 2005/097834 | 10/2005 |

* cited by examiner

USE IN DETERGENT COMPOSITIONS OF POLYMERS OBTAINED BY LOW-CONCENTRATION REVERSE EMULSION POLYMERIZATION WITH A LOW CONTENT OF NEUTRALIZED MONOMERS

The invention relates to the technical field of detergent compositions for household or industrial use suitable for washing and cleaning a variety of surfaces and, more precisely, it provides the use in this field of synthetic acrylic polymers comprising at least one weak acid function, obtained under particular conditions by the reverse emulsion polymerization process starting from at least one monomer carrying a weak acid function, and it also provides the corresponding detergent compositions.

The term "detergent compositions for household or industrial use", means compositions for cleaning a variety of surfaces, in particular textile fibers, hard surfaces of any nature such as dishes, floors, window glass, and surfaces made of wood, metal, or composites. By way of example, compositions of this type correspond to laundry detergents for washing laundry by hand or in a washing machine, to products for cleaning dishes by hand or in dishwashers, to detergent products for washing home interiors such as kitchen elements, toilets, furniture, floors, window glass, and to other general purpose cleaning products. Detergent compositions for household or industrial use do not include compositions intended for cleaning keratinous material (skin, hair, etc.), and thus they encompass neither cosmetic compositions nor dermatological compositions nor pharmaceutical compositions with a cleaning component. In the remainder of the description, the "detergent compositions for household or industrial use" are sometimes referred to more simply as "detergent compositions".

Detergent compositions of this type were initially developed in the form of powders, but that form suffered from disadvantages in use: slow dissolution in cold water, generation of dust, difficulty with dosage. For this reason, liquid versions of those compositions were developed, enabling the problems mentioned above to be overcome. Liquid detergents have gained popularity and have gradually replaced powder detergents throughout the world.

The term "liquid compositions" encompasses compositions in the form of a solution, gel, or dispersion.

However, adapting and formulating liquid detergent compositions is complicated. One of the challenges of such an adaptation has been and still remains controlling its rheology. Thickeners or rheology modifiers are thus widely used in such compositions in order to adapt their viscosity to the demands of the consumer, who often thinks "the thicker the better", but also to suspend or stabilizer the active agents present in the composition.

Natural and synthetic polymers are used as thickeners. Examples that may be mentioned are hydroxycelluloses, carboxymethyl celluloses, polysaccharides, polyacrylamides, acrylic polymers, polyvinylalcohols, polyurethanes, polyvinylpyrrolidones, ethylene polyoxides, etc. One problem that is encountered when thickening detergent compositions is linked to the presence of surfactants, which are necessary for their cleaning function, and which degrade the rheological behavior of compositions thickened using a polymer. This results in a loss of viscosity or a lack of the stability of that viscosity over time.

A variety of documents describe liquid detergent compositions. Patent EP 0 759 966 B1 in the name of Johnson & Son, Inc. proposes associative polymers to thicken laundry detergent for laundry containing large quantities of nonionic surfactant: 5% to 30% by weight.

In that document, the polymers used, such as Acusol® 820 marketed by Rohm and Haas C are obtained by emulsion polymerization and are generally known as latexes.

U.S. Pat. No. 6,274,539 in the name of Procter & Gamble Company describes compositions for hand dishwashing containing, in particular, 20% to 40% by weight of anionic surfactant, 3% to 10% by weight of nonionic surfactant, and 0.2% to 2% of a thickening agent corresponding to an associative ethyl acrylate copolymer, steareth-20, and (meth)acrylic acid. Acusol® 820 is cited as an example of a thickening polymer of that type.

Another patent application in the name of the same company, application US 2006/0281660, proposes optimized thickening of detergent compositions for the dishwasher by means of high molecular weight polycarboxylates such as commercial products with the brand name Carbopol® from Noveon, or Flogel 700 from SNF Floerger. All of those polymers are obtained using the precipitation polymerization technique.

U.S. Pat. No. 7,973,004 in the name of Hercules Incorporated describes the use of a thickening agent in the form of an associative polymer, wherein the hydrophobic portions are more resistant in the presence of surfactant. Example 6, which provides a cleaning formulation for household use, uses a modified polyacetal polyether, Aquaflow® XLS500, as the associative polymer; it is a polymer obtained by the precipitation polymerization technique.

Patent application GB 2 346 891 proposes thickening cleaning compositions to clean a hard surface with the aid of hydrophobically modified polycarboxylates such as the commercial products Polygel® W30 from 3V UK Ltd and Rheovis CRX and CR from Allied Colloids.

The best-performing polymers currently in detergent compositions are thus either polycarboxylates or cross-acid linked acrylic homopolymers obtained by precipitation polymerization such as Carbopol® polymers, or polymers known as associative polymers with the major portion being hydrophilic and with hydrophobic portions, such as Acusol® 820 obtained by emulsion polymerization. However, it has been found in use that those polymers are still sensitive to the presence of surfactants in the detergent compositions.

It should also be noted that the polymers obtained by reverse emulsion polymerization are not used to thicken detergent compositions and instead are considered by the professionals in the field of detergent compositions to be ineffective as a thickening agent in such compositions.

Thus, it appears that there is a genuine need for improving existing detergent compositions. The aim of the invention is to propose detergent compositions having rheological behavior that means that they can be used easily and that they are adapted to incorporating a wide range of surfactants, while having excellent resistance to surfactants. In this context, the Applicant has developed polymers obtained by reverse emulsion polymerization having improved thickening performance, making them compatible with their use in detergent compositions. It has also been found that such polymers have better resistance to the surfactants that are in conventional use in detergent compositions.

Thus, in order to thicken liquid detergent compositions, the aim of this invention is to propose the use of an acrylic polymer obtained by employing particular conditions in a reverse emulsion polymerization process, said polymer therefore having good thickening efficiency and being compatible with its use in detergent compositions. Furthermore, polymers of this type are resistant to the surfactants conventionally used in detergent compositions of this type.

The present invention provides the use, for the manufacture of an aqueous liquid detergent composition for household or industrial use, of a branched or cross-linked polymer composed by repeating one or more monomeric units, with at least one of the monomeric units corresponding to a monomer comprising an acrylic group and at least 30 molar percent (mol %) of the monomeric units carrying at least one weak acid function that is optionally in the neutralized form, said polymer being obtained:

by polymerizing an aqueous solution of one or more monomers by water-in-oil reverse emulsion, at least one of the monomers used being an acrylic monomer and one or more of the monomers used being a monomer carrying at least one weak acid function, the molar percentage of monomers carrying at least one weak acid function relative to the totality of the monomers used being at least 30%, the aqueous phase containing at least one monomer acting as a branching agent, in a manner such that the polymerization results in a branched or cross-linked polymer, characterized in that:

i) the polymerization is carried out with a total concentration of the monomers in aqueous solution being in the range 1.3 mmmol to 3.6 mmmol per gram of aqueous solution;

ii) during the polymerization, at most 20% of the acid functions present on the monomers having at least one acid function are in the neutralized form;

the polymerization optionally being followed by one or more of the following steps:

diluting or concentrating the emulsion obtained;

isolating in order to obtain the polymer in the form of a powder;

at least partially neutralizing the free acid functions present in the polymer obtained.

A polymer of this type defined by the process for obtaining it is termed a "thickening polymer", "acrylic polymer", or "branched or cross-linked polymer" in the remainder of the description.

The invention also provides the use of a thickening polymer of this type in order to thicken an aqueous liquid detergent composition for household or industrial use. Preferably, in order to obtain the desired thickening effect, the thickening polymer comprises a percentage of neutralized acid functions from 30% to 100% relative to the totality of the acid functions present on the polymer, obtained by a step of at least partially neutralizing the acid functions present on the polymer carried out after the polymerization, but before or after preparing the composition.

The invention also provides the aqueous liquid detergent compositions for household or industrial use comprising at least one such thickening polymer, the polymerization being followed by a step of at least partially neutralized the acid functions present, which step is carried out before or after incorporating the polymer into the composition; and optionally by one or more of the following steps, carried out before incorporating the polymer into the composition:

diluting or concentrating the emulsion obtained;

isolating in order to obtain the polymer in the form of a powder.

The use of these more surfactant-resistant polymers in the manufacture of detergent compositions makes it possible to reduce the viscosity due to the presence of the surfactant or surfactants incorporated into the composition.

Such detergent compositions for household or industrial use are in particular in the form of a solution, gel, or dispersion, and in particular of an aqueous solution, an aqueous gel, or an aqueous dispersion. The term "aqueous composition" (in particular solution, gel, or dispersion) means a composition comprising a portion of water, and in particular a portion of water representing at least 10% by weight of the composition weight.

Examples of these compositions that are capable of and intended for cleaning textile fibers such as laundry detergents for hand washing or for use in a washing machine; compositions that are capable of and intended for cleaning hard surface of any nature, such as dishes (whether for manual cleaning or in a dishwasher), floors, window glass, or surfaces made of wood, metal, or composites, furniture, kitchen elements, toilets; and general purpose cleaning products. Detergent compositions for household or industrial use in accordance with the invention do not include compositions intended for cleaning keratinous materials (skin, hair, etc.) and thus include neither cosmetic compositions nor dermatological compositions nor pharmaceutical compositions with a cleaning component.

The invention also provides the use of a composition in accordance with the invention for cleaning textile fibers, in particular for washing laundry by hand or in a washing machine, or for cleaning hard surfaces such as dishes, furniture, floors, window glass, wood or metals, in particular to clean dishes by hand or in a dishwasher, etc.

Such a use comprises in particular applying the composition to the surface to be cleaned, optionally followed by rinsing with water.

The uses and compositions in accordance with the invention preferably exhibit one or more of the following features, or any combination of these features, or even all of the features below when they are not mutually exclusive:

during the polymerization, at most 10%, preferably at most 5%, and preferably at most 2% of the acid functions present on the monomers having at least one acid function are in the neutralized form; in accordance with a particular embodiment, all of the acid functions present on the monomers are in the free acid form during the polymerization;

the polymerization is carried out with a total concentration of the monomers in aqueous solution in the range 1.7 to 3.3 mmol per gram of aqueous solution;

the polymer comprises a molar percentage of monomeric units carrying one or more weak acid function(s), relative to the totality of the monomeric units carrying an acid function of at least 50%, preferably at least 70%, more preferably at least 80%;

all of the monomers used for the preparation of the polymer are monomers containing at least one ethylenically unsaturated bond;

the monomeric unit(s) carrying at least one weak acid function in the free form, is(are) selected from acrylic acid, methacrylic acid, itaconic acid, crotonic acid, maleic acid, and fumaric acid, with acrylic acid being preferred;

the polymer is a copolymer comprising at least one neutral monomeric unit selected from acrylamide, methacrylamide, N,N-dimethylacrylamide, N-vinylmethylacetamide, N-vinylformamide, vinyl acetate, diacetone acrylamide, N-isopropyl acrylamide, N-[2-hydroxy-1, ibis (hydroxymethyl) ethyl] propenamide, (2-hydroxyethyl) acrylate, (2,3-dihydroxypropyl) acrylate, methyl methacrylate, (2-hydroxyethyl) methacrylate, (2,3 dihydroxypropyl) methacrylate, and vinylpyrrolidone;

either all of the monomeric units carrying at least one acid function present in the polymer are monomeric units carrying one or more weak acid function(s), in particular, the polymer present in the composition is an acrylic acid/acrylamide copolymer with 30% to 100% of the acrylic acid functions in the neutralized form; or the polymer is a copolymer comprising at least one monomeric unit carrying one or more strong acid function(s), preferably, the molar percentage of monomeric units carrying one or more strong acid function(s) relative to the totality of the monomeric units is less than 50% and preferably less than 30%, as an example, the monomeric unit(s) carrying one or more strong acid function(s), in the free form, is(are) selected from acrylamidoalkylsulfonic acids such as 2-acrylamido-2-methylpropane sulfonic acid, in particular, the polymer present in the composition is a copolymer of 2-acrylamido-2-methylpropane sulfonic acid and acrylic acid or of 2-acrylamido-2-methylpropane sulfonic acid and acrylic acid and acrylamide, with 30% to 100% of the acid functions present on the polymer being in the neutralized form;

the branching agent is selected from methylene bisacrylamide (MBA), ethylene glycol diacrylate, polyethylene glycol dimethacrylate, diacrylamide, cyanomethylacrylate, vinyloxyethylacrylate, vinyloxymethacrylate, triallylamine, formaldehyde, glyoxal, glycidyl ethers such as ethylene glycol diglycidylether, epoxies, and mixtures thereof; preferably, the quantity of branching agent is between 5 and 10000 ppm by weight relative to the total weight of the monomers, and preferably between 100 and 5000 ppm;

the polymerization reaction is carried out in the presence of a water-in-oil emulsifying agent;

the polymerization is carried out with a transfer agent, for example selected from methanol, isopropyl alcohol, sodium hypophosphite, 2-mercaptoethanol, sodium methallylsulfonate, and mixtures thereof; preferably, the quantity of transfer agent is between 0 and 5000 ppm by weight relative to the total weight of the monomers, and between 10 and 2500 ppm;

the branched or cross-linked polymer introduced into the composition has a viscosity, at 0.16% by weight in deionized water having its pH adjusted to 7±0.1 with sodium hydroxide, and measured at 25° C. with a Brookfield RVT apparatus (speed of rotation 20 revolutions per minute (rpm)), in the range from 2000 mPa·s to 100000 mPa·s, in particular in the range 3000 mPa·s to 50000 mPa·s; the procedure for measuring the viscosity of the aqueous 0.16% by weight polymer solution is preferably as follows: 250 g of deionized water is introduced into a 400 mL beaker, then with mechanical stirring (triple bladed mixer—500 rpm), the desired quantity of polymer for obtaining a solution containing 0.16% by weight of acrylic polymer is slowly added with stirring; preferably, the added polymer is in the form (reverse emulsion, dry powder, solution in water, etc.) in which it is used to prepare the detergent composition; the pH is then adjusted to 7±0.1 with sodium hydroxide; at this pH, 100% of the acid functions present on the polymer are neutralized; the solution is stirred for 15 minutes then left to rest for 5 minutes; the viscosity is then measured using a RVT type Brookfield viscosimeter (speed of rotation 20 rpm). The branched or cross-linked polymer present in the composition can thus be used to thicken the composition to a specific viscosity as measured at 25° C. with a Brookfield instrument that lies in the range 10 mPa·s to 100000 mPa·s, in particular in the range 100 mPa·s to 50000 mPa·s; in particular, the compositions in accordance with the invention should have a viscosity in the range 500 mPa·s to 30000 mPa·s;

the composition comprises 0.01% to 10% by weight of branched or cross-linked acrylic polymer relative to the total weight of the composition, and preferably 0.1% to 5% by weight of branched or cross-linked acrylic polymer;

the composition comprises one or more surfactant(s) preferably selected from anionic and nonionic cleaning surfactants;

the composition comprises 0.1% to 50% by weight of surfactant(s) preferably selected from anionic and nonionic cleaning surfactants, relative to the total composition weight, and preferably 1% to 30% by weight of surfactant(s) preferably selected from anionic and nonionic cleaning surfactants, selected in particular from those defined in the description below;

the composition comprises at least one additive selected from: detergent additives, also known as "builders", anti-soiling agents, antiredeposition agents, bleaching agents, fluorescence agents, foam suppressing agents, enzymes, chelating agents, neutralizing agents, and pH-adjusting agents; and the composition comprises at least one cleaning surfactant agent and at least one detergent additive as defined in the description below and, preferably, at least one other additive selected from: anti-soiling agents, antiredeposition agents, bleaching agents, fluorescence agents, foam suppressing agents, enzymes, chelating agents, neutralizing agents, and pH-adjusting agents, in particular selected from those defined in the description below.

The thickening polymers used in the context of the invention and their production process is described first.

The polymers used in the context of the invention are composed of repetitions of one or more monomeric units with at least one of the monomeric units corresponding to a monomer comprising an acrylic group. In other words, they correspond to homopolymers obtained by polymerization of a monomer comprising an acrylic group or to copolymers obtained by copolymerization of a mixture of monomers, at least one of which comprising an acrylic group. For the purposes of simplicity, in the remainder of the description, polymers of this type are referred to simply as acrylic polymers.

In order to carry out their role as a thickener effectively, the polymers used in the context of the invention are water-soluble or water-swellable. The monomers used to prepare these polymers and in particular the amount of hydrophilic monomers, is selected in a manner such as to obtain such properties.

The term "water-soluble" polymer means a polymer that, when dissolved in water with the aid of stirring at a temperature of 25° C. in a concentration of 50 g/L, provides a solution that is free from insoluble particles.

The term "water-swellable" polymer means a polymer that, when dissolved in water at a temperature of 25° C., swells and thickens the solution.

The polymers used in the context of the invention are branched or cross-linked. As is conventional, the term "branched polymers" means non-linear polymers that have side chains. Branched polymers include in particular star polymers and comb polymers. As is conventional, the term "cross-linked polymer" means a non-linear polymer that is in the form of a three-dimensional network that is insoluble in water but swellable in water.

Cross-linking is obtained by using a branching agent during polymerization that is integrated into the aqueous phase. A branching agent of this type corresponds to a monomer comprising two or more ethylenically unsaturated bonds and is, by way of example, it is selected from methylene bisacrylamide (MBA), ethylene glycol diacrylate, polyethylene glycol dimethacrylate, diacrylamide, cyanomethylacrylate, vinyloxyethylacrylate, vinyloxymethacrylate, triallylamine, formaldehyde, glyoxal, glycidylethers such as ethyleneglycol diglycidylether, epoxies, and mixtures thereof.

It should be pointed out that in the context of the invention, the total concentration of monomers given in relation to the polymerization process includes monomers acting as the branching agent.

In the context of the invention, the Applicant has focused on using acrylic polymers corresponding to or obtained from a reverse emulsion of polymers prepared by reverse emulsion water-in-oil polymerization with the use of a high molar percentage of monomers carrying one or more weak acid function(s) relative to the totality of the monomers used, and in particular comprising at least 30 mol % of monomers carrying at least one weak acid function. With this level of monomers carrying a weak acid function, the inventors have demonstrated that the properties of the polymer obtained are in fact dependent firstly on the degree of neutralization of the acid functions of the monomers used during the polymerization, and secondly on the total concentration of monomers in the aqueous phase. In a step that is original compared with the approaches proposed in the prior art, which recommend carrying out polymerization with a high degree of neutralization of the acid functions, the Applicant has focused, in the context of the invention, on a reverse emulsion polymerization process for polymers with a low degree of neutralization, and in particular with a degree of neutralization of the acid functions present of at most 20%.

In the context of the invention, the Applicant proposes using such a polymer obtained by reverse emulsion water-in-oil polymerization of an aqueous solution of monomers, in which the polymerization is carried out with a concentration of the totality of the monomers in the range 1.3 mmol to 3.6 mmol per gram of aqueous solution. In addition, the Applicant has demonstrated that such a concentration range, in contrast to higher concentrations used in the prior art, is compatible with obtaining a polymer with a low degree of neutralization of the weak acid functions present and can be used to overcome the stability problems encountered in the prior art.

In the context of the invention, the polymer used is obtained by carrying out a process for preparing a polymer by polymerizing an aqueous solution of one or more monomers by water-in-oil reverse emulsion, in which one or more of the monomers used comprise at least one acid function, the molar percentage of monomers carrying at least one weak acid function relative to the totality of the monomers being used being at least 30%, characterized in that:

i) the polymerization is carried out with a concentration of the totality of the monomers in aqueous solution being in the range 1.3 mmol to 3.6 mmol per gram of aqueous solution;

ii) during the polymerization, at most 20% of the acid functions present on the monomers used having at least one acid function are in the neutralized form.

In particular, during the polymerization, at most 10%, preferably at most 5%, and more preferably at most 2% of the acid functions present on the monomers used having at least one acid function are in the neutralized form, which means that even more advantageous thickening properties can be obtained. In a particular embodiment, 100% of the acid functions present on the monomers used are in the free acid form during the polymerization.

In the context of the invention, in optimized manner, the polymerization is carried out with a total concentration of monomers present in the aqueous solution in the range 1.7 mmol to 3.3 mmol per gram of aqueous solution. In the context of the invention, the concentrations of monomers are given relative to the total weight of the aqueous solution (also referred to as the aqueous phase), i.e. including the weight of the monomers.

In particular, it is thus possible to carry out the polymerization with the following combinations:

- a concentration of the totality of the monomers in aqueous solution being in the range 1.3 mmol to 3.6 mmol per gram of aqueous solution, with at most 20%, advantageously at most 10%, preferably at most 5%, and more preferably at most 2%, or even 0% of the acid functions present on the monomers having at least one acid function that is in the neutralized form;
- a concentration of the totality of the monomers in aqueous solution in the range 1.7 mmol to 3.3 mmol per gram of aqueous solution, with at most 20%, advantageously at most 10%, preferably at most 5%, and more preferably at most 2%, or even 0% of the acid functions present on the monomers having at least one acid function that is in the neutralized form.

The molar percentage of monomers carrying at least one weak acid function relative to the totality of the monomers being used is preferably at least 50%, more preferably at least 70%, even more preferably at least 80%. Molar percentages of this type may be used in any combination of monomer concentration/degree of neutralization mentioned above.

In the context of the invention, preferably, the polymerization is carried out with monomers that all contain at least one ethylenically unsaturated bond.

Preferably, the polymerization is carried out with a single monomer carrying at least one weak acid function for which the molar percentage relative to the totality of the monomers used is at least 30%, which in the free form is selected from acrylic acid, methacrylic acid, itaconic acid, crotonic acid, maleic acid, and fumaric acid. Very preferably, the monomer carrying at least one weak acid function is acrylic acid in the free form or with a degree of neutralization in accordance with the invention. It is also possible to use a plurality of monomers carrying at least one weak acid function, in particular selected from those listed above, for which the total molar percentage relative to the totality of the monomers used is at least 30%. Preferably, one of these monomers is acrylic acid in the free form or with a degree of neutralization in accordance with the invention.

The polymerization may be carried out with at least one monomer carrying at least one strong acid function. In this case, the polymerization is preferably carried out with a concentration of monomers carrying at least one strong acid function relative to the totality of the monomers being used of less than 50%, and preferably of less than 30%. By way of example, the polymerization may be carried out with a monomer carrying at least one strong acid function that in the free form is selected from acrylamidoalkylsulfonic acids such as 2-acrylamido-2-methylpropane sulfonic acid (ATBS). By way of example, the polymerization may then be carried out with a combination of acrylic acid and ATBS or of acrylic acid and ATBS and acrylamide, the acid monomers possibly being in the free form or with a degree of neutralization in accordance with the invention.

In the context of the invention, it has been shown that by selecting a concentration of monomers in the range 1.3 mmol to 3.6 mmol per gram of aqueous solution in order to carry out the reverse emulsion polymerization reaction, it is possible to prepare reverse emulsions of polymers carrying an acid function with a low degree of neutralization, or even no neutralization, which are stable, i.e. without observing a rapid precipitation phenomenon. Moreover, it has been demonstrated that such a range of concentrations, in contrast to higher concentrations that have in particular been used in the prior art, associated with low neutralization of the acid functions present, can be used to obtain polymers endowed with a thickening efficiency after a step of at least partial neutralization, that is higher than with prior art polymers obtained by reverse emulsion polymerization. In addition, it has been shown that these polymers are more resistant to the surfactants used in detergent compositions and that their use in the manufacture of detergent compositions means that the drop in viscosity due to the presence of surfactant(s) can be reduced. Their thickening efficiency is highly satisfactory, in contrast to polymers obtained by reverse emulsion polymerization employing other conditions for concentrating monomers and/or neutralizing acid functions. In addition, it has been shown that these polymers are more resistant to surfactants than the polymers obtained by precipitation polymerization or by emulsion polymerization as used in the prior art, and that their use in the manufacture of detergent compositions is compatible with using a wide range of surfactants.

The term "monomer carrying at least one acid function" is used to mean a monomer carrying one or more acid function(s) that is(are) free or neutralized (i.e. in the salt form by action of a base). The term "acid function" without further definition thus refers to acid functions both in the free form and also in the neutralized form. When a monomer comprises more than one acid function, it is possible to have only a portion of the acid functions in the neutralized form. The acid function or functions present may be a weak acid function or a strong acid function. In general, a monomer used in the context of the invention only comprises weak acid functions or strong acid functions, and usually, monomers carrying a single acid function are used. The same definitions and preferences apply to the monomeric units present on the polymer obtained.

Examples of monomers carrying at least one weak acid function in the free form of the —COOH type that may be mentioned are acrylic acid, methacrylic acid, itaconic acid, and crotonic acid, which all contain a single weak acid function, and maleic acid and fumaric acid, each of which contains two weak acid functions.

Examples of monomers carrying a strong acid function in the free form that may be mentioned are monomers carrying a phosphonic acid or sulfonic acid function such as acrylamidoalkylsulfonic acids such as 2-acrylamido-2-methylpropane sulfonic acid.

In their neutralized form, the acid functions are in the anionic form with a counter-ion or cation that depends on the base used for neutralization, for example of the $Na^+$ type when sodium hydroxide is used, or indeed of the $NH_4^+$ type when ammonia is used. Conventionally, the number of acid functions in the neutralized is controlled by selecting the pH of the aqueous solution of monomers that is adjusted as a function of the acid dissociation constant (pKa) of the acid functions present.

The polymerization may employ a single type of monomer, which is then selected from monomers carrying at least one weak acid function, or may employ different types of monomers, at least one of which is carrying at least one weak acid function, with a proportion of acid functions present in a neutralized form on the monomers used, and thus on the copolymer obtained, that is less than or equal to 20%. In particular, in addition to the monomeric unit or units carrying at least one weak acid function as described above, the polymer obtained may contain other monomeric units such as monomeric units carrying at least one strong acid function, neutral (or nonionic) monomeric units, cationic monomeric units, and/or indeed monomeric units of a hydrophobic nature. Under all circumstances, the conditions for forming the the aqueous phase and for polymerizing are such that the acid functions of the monomers employed are primarily in the free form, and are not neutralized by forming a salt form, or are neutralized a little, with a limited degree of neutralization less than or equal to 20%. When neutralization of less than or equal to 20% takes place, it is generally carried out in the aqueous phase, by adding an appropriate quantity of base. A base such as sodium hydroxide or ammonia may be used.

In particular, the polymerization reaction may be carried out with at least one neutral monomer selected from acrylamide, methacrylamide, N,N-dimethylacrylamide, N-vinylmethylacetamide, N-vinylformamide, vinyl acetate, diacetone acrylamide, N-isopropyl acrylamide, N-[2-hydroxy-1,1-bis(hydroxymethyl) ethyl]propenamide, (2-hydroxyethyl) acrylate, (2,3-dihydroxypropyl) acrylate, methyl methacrylate, (2-hydroxyethyl) methacrylate, (2,3-dihydroxypropyl) methacrylate, vinylpyrrolidone, or other acrylic esters, or other esters containing an ethylenically unsaturated bond. As an example, the polymerization may be carried out with 30 mol % to 99 mol % of at least one monomer having one or more weak acid function(s) and 1 mol % to 70 mol % of at least one neutral monomer. By way of example, the polymerization may be carried out with a combination of acrylic acid and acrylamide, the acrylic acid being in the neutral form or with a degree of neutralization in accordance with the invention.

It is also possible to carry out a copolymerization with at least one cationic monomer. Examples of cationic monomers that may be mentioned are diallyldialkyl ammonium salts such as diallyl dimethyl ammonium chloride (DADMAC); acidified or quaternized salts of dialkyl aminoalkyl acrylates and methacrylates, in particular dialkyl aminoethyl acrylate (ADAME), and dialkyl aminoethyl methacrylate (MADAME); acidified or quaternized salts of dialkyl-aminoalkyl acrylamides or methacrylamides such as, for example, methacrylamidopropyl trimethyl ammonium chloride (MAPTAC), acrylamidopropyl trimethyl ammonium chloride (APTAC), and Mannich products such as quaternized dialkyl aminomethyl acrylamides.

The acidified salts are obtained by means that are known to the person skilled in the art, and in particular by protonation. The quaternized salts are also obtained by means that are known to the person skilled in the art, by reaction with benzyl chloride, methyl chloride (MeCl), aryl, or alkyl chlorides, or dimethylsulfate.

It is also possible to carry out copolymerization with at least one monomer of a hydrophobic nature. Examples of monomers of a hydrophobic nature that may be mentioned are undecanoic acid acrylamide, undodecyl acid methyl acrylamide, acrylic acid derivatives such as alkyl acrylates, or methacrylates such as, for example, ethoxylated behenyl methacrylate (EO 25). The molar percentage of monomers of a hydrophobic nature relative to the totality of the monomers being used is then preferably less than 10%, and generally between 0.001% and 7%. The copolymers obtained with such monomers of a hydrophobic nature provide associative copolymers.

In accordance with a first variation of the process in accordance with the invention, all of the monomers carrying at least one acid function used to carry out the polymerization are monomers carrying at least one weak acid function.

In accordance with a second variation of the process in accordance with the invention, the polymerization is carried out with at least one monomer carrying at least one strong acid function, in addition to at least one monomer carrying at least one weak acid function. The molar percentage of monomers carrying at least one strong acid function relative to the totality of the monomers used is then preferably less than 50%, more preferably less than 30%.

The copolymers obtained in accordance with the process of the invention may in particular be formed: by a combination of at least one monomeric unit carrying at least one weak acid function and at least one monomeric unit carrying at least one strong acid function, and may in particular correspond to a copolymer of acrylic acid and ATBS, these acid monomers being in the neutral form or with a degree of neutralization that is in accordance with the invention; or by a combination of at least one monomeric unit carrying at least one weak acid function with at least one neutral monomeric unit and optionally at least one monomeric unit carrying at least one strong acid function, and in particular corresponding to a copolymer of acrylic acid and acrylamide or to a copolymer of acrylic acid and ATBS and acrylamide, the acrylic acid and the ATBS being in the neutral form or with a degree of neutralization in accordance with the invention; or by a combination of at least one monomeric unit carrying at least one weak acid function with at least one cationic monomeric unit and optionally at least one monomeric unit carrying at least one strong acid function; or indeed by a combination of at least one monomeric unit carrying at least one weak acid function with at least one neutral monomeric unit and at least one cationic monomer and optionally at least one monomeric unit carrying at least one strong acid function.

In the reverse emulsion polymerization process used in the context of the invention, the monomers are placed in aqueous solution. This aqueous solution corresponds to the aqueous phase of the reverse emulsion. In the context of the invention, in the aqueous solution used for the polymerization, at most 20% of the acid functions present on the monomers have at least one acid function in the neutralized form.

It is possible to use a transfer agent, also known as a chain limiting agent. The use of a transfer agent is particularly advantageous in order to control the molecular weight of the polymer obtained. Examples of transfer agents that may be mentioned are methanol, isopropanol, sodium hypophosphite, 2-mercaptoethanol, sodium methallysulfonate, and mixtures thereof. In known manner, the person skilled in the art should adjust the quantities used of the branching agent and optionally of the transfer agent as a function of whether a branched or cross-linked polymer is to be obtained and of the desired viscosity.

In more detail, the process used in the context of the invention comprises the following steps:

a) providing an aqueous solution of the selected monomer or monomers, termed the aqueous phase;

b) emulsifying said aqueous solution in a phase that is not miscible with water, termed the oily phase;

c) carrying out the polymerization reaction.

Clearly, the aqueous solution of step a) has a total concentration of monomers, a molar percentage of monomers carrying at least one weak acid function relative to the totality of the monomers used, and a degree of neutralization of the acid functions present on the monomers having at least one acid function in accordance with the process described in the context of the invention.

In conventional manner, step b) of emulsifying the aqueous phase in the oily phase is preferably carried out by adding the aqueous phase to the oily phase that is stirred continuously.

In general, the polymerization reaction is carried out in the presence of a water-in-oil emulsifying agent. This agent is usually introduced into the oily phase in which the aqueous solution is emulsified. The term "water-in-oil (W/O) emulsifying agent" means an emulsifying agent having a hydrophile-lipophile balance (HLB) value that is sufficiently low to provide water-in-oil emulsions, and in particular an HLB value of less than 10.

The HLB value is calculated using the following relationship:

$$HLB=(\%\text{ by weight of the hydrophilic portion})/5$$

The percentage by weight of the hydrophilic portion is the ratio between the molecular weight of the hydrophilic portion and the total molecular weight of the molecule.

Examples of water-in-oil emulsifying agents of this type that may be mentioned are surfactant polymers such as polyesters with a molecular weight between 1000 and 3000 g/mol, condensation products of poly(isobutenyl) succinic acid or its anhydride and a polyethylene glycol, block copolymers with a molecular weight between 2500 g/mol and 3500 g/mol, for example those marketed under the HYPERMER® brand names, sorbitan extracts such as sorbitan monooleate, sorbitan isostearate, or sorbitan sesquioleate, certain polyethoxylated sorbitan esters such as pentaethoxylated sorbitan monooleate or pentaethoxylated sorbitan isostearate, or indeed diethoxylated oleocetyl alcohol, or tetraethoxylated lauryl acrylate.

In the reverse emulsion polymerization process, the aqueous solution contains the monomer(s) and optionally the branching agent and the transfer agent. It may also contain complexing agents such as ethylene diamine or ethylene diamine tetraacetic acid.

Usually, the polymerization reaction of step c) is initiated by introducing a free radical initiator into the emulsion formed in step b). Examples of free radical initiators that may be mentioned are redox reagents selected from cumene hydroperoxide oxidizing agents or tertiary butylhydroxyperoxide, and from persulfate reducing agents such as sodium metabisulfite and Mohr's salt. Azo compounds such as 2,2'-azobis(isobutyronitrile) and 2,2'-azobis(2-amidinopropane) hydrochloride may also be used.

Conventionally, the polymerization is generally carried out isothermally, adiabatically, or under controlled temperature. This means that the temperature is kept constant, generally between 10° C. and 50° C. (isothermal), or indeed the temperature is allowed to increase naturally (adiabatic) with the reaction then generally being initiated at a temperature of less than 10° C. and the final temperature is generally more than 50° C., or finally, the rise in temperature is controlled so that the temperature curve lies between the isothermal and the adiabatic curve.

It is possible to introduce one or more oil-in-water emulsifying agents at the end of the polymerization reaction, preferably at a temperature of less than 50° C.

The term "oil-in-water type emulsifying agent (O/W)" is used to mean an emulsifying agent having an HLB value that is sufficiently high to provide oil-in-water emulsions and in particular an HLB value of more than 10. Examples of such oil-in-water emulsifying agents that may be mentioned are ethoxylated sorbitan esters such as sorbitan oleate ethoxylated with 20 equivalents of ethylene oxide (EO 20), sorbitan laurate polyethoxylated with 20 moles of ethylene oxide, castor oil polyethoxylated with 40 moles of ethylene oxide, decaethoxylated oleodecyl alcohol, heptaethoxylated lauric alcohol, or sorbitan monostearate polyethoxylated with 20 moles of ethylene oxide.

The quantities of emulsifying agent(s) introduced are such that the resulting reverse emulsion of the polymer generally contains 1% to 10% by weight, and preferably 2.5% to 9% by weight of emulsifying agents of the water-in-oil type (W/O) and, optionally, 2% to 10% by weight, and preferably 2.5% to 6% by weight of oil-in-water type emulsifying agents (O/W).

In general, the ratio by weight of the aqueous phase to the oily phase is 50/50 to 90/10.

By way of example, the oily phase used in the reverse emulsion polymerization process may be composed of a mineral oil, in particular a commercially available mineral oil, containing saturated paraffinic, isoparaffinic, cycloparaffinic, naphthalic type hydrocarbons having specific gravity between 0.7 and 0.9 at ambient temperature (22° C.); a vegetable oil; a synthesized oil such as hydrogenated polydecene or hydrogenated polyisobutene; an ester such as octyl stearate or butyl oleate; a vegetable oil such as vegetable origin squalane; or a mixture of two or more of these oils.

At the end of the polymerization reaction, it is also possible for the resulting emulsion to be diluted or concentrated. In particular, it is possible to concentrate the resulting emulsion by distillation, or indeed to dry it out completely in order to obtain a powder. Concentration or drying of this type may be carried out with or without prior introduction of the oil-in-water (O/W) type emulsifying agent.

The reverse emulsions obtained in this manner may be concentrated, for example by distillation. Reverse emulsions are then obtained the concentration of polymer of which may be between 30% and 75% by weight, preferably between 40% and 65% by weight.

The polymers obtained from reverse emulsions that subsequently undergo an isolation step, may be in the form of a powder. By way of example, an isolation step of this type may, for example, be selected from precipitation techniques, azeotropic distillation and from drying by spraying and atomization.

In fact, in the context of the invention, it is possible to concentrate or isolate the polymer in the form of a reverse emulsion obtained directly from the end of the reverse emulsion polymerization process without losing the advantageous properties of the polymers obtained. In particular, there are many processes for obtaining powder from reverse emulsions of polymers that consist in isolating the active material from the other constituents of the emulsion such as, for example:

- precipitation in a non-solvent medium such as acetone, methanol or any other polar solvent in which the polymer is not soluble. Simple filtration may then be used to isolate the polymer particle.
- azeotropic distillation in the presence of an agglomerating agent and stabilizing polymer in order to produce agglomerates that are readily isolated by filtration before proceeding to dry the particle.
- spray-drying, consisting in creating a cloud of fine droplets of emulsion in a current of hot air for a controlled period of time.

The polymers obtained after such steps retain their advantageous properties in terms of the thickening capacity and in terms of resistance to surfactants.

Without an additional neutralization step, in the polymers obtained at the end of the reverse emulsion polymerization process or after a drying or concentration step, at most 20% of the acid functions present are in the neutralized form, preferably at most 10%, more preferably at most 5%, and still more preferably at most 2%. This low degree of neutralization of the acid functions that are present offers great flexibility to the formulator, making it possible to adjust the properties of the polymer and thus the desired thickening effect by tailoring the degree of neutralization. An approach of this type also allows the formulator to select a nature of the neutralizing agent used that is compatible with the target use.

In order to obtain the desired thickening effect, the polymerization is usually followed by a step of neutralization, also known as the post-neutralization step, in order to neutralize at least a portion or even all of the free acid functions present on the polymer. When a step of at least partial neutralization of the free acid functions present in the polymer obtained is carried out after the polymerization reaction, it preferably results in a percentage neutralization relative to the totality of the acid functions present on the polymer of 30% to 100%.

A post-neutralization step of this type may be carried out in different manners:

- the post-neutralization may be carried out on the reverse emulsion obtained at the end of the reverse emulsion polymerization process. This generally applies when it is the manufacturer that neutralizes the polymer in the form of a reverse emulsion;
- the post-neutralization may be carried out on an aqueous solution obtained following reversal of the reverse emulsion in water. This generally applies when the formulator uses the reverse emulsion or the powder resulting therefrom in an aqueous solution, termed the stock solution, before adding the stock solution to the composition to be thickened. The formulator is then free to adjust the concentration of polymer of the solution, the degree of neutralization, and the nature of the neutralizing agents;
- the post-neutralization may also be carried out on the composition into which the reverse emulsion or the powder resulting therefrom has been incorporated. In the same manner as in the preceding case, the consumer is then free to adjust the degree of neutralization and nature of the neutralizing agents.

The neutralization is carried out using a base, in similar manner to the neutralization of the monomers described above in the context of the polymerization process, the nature and quantities of which are selected by the person skilled in the art.

These polymers neutralized in this manner provide much better thickening and surfactant-resistant properties, all other conditions being equal, compared with polymers obtained by reverse emulsion polymerization that do not comply with the concentration and monomer neutralization conditions as defined in the process in accordance with the invention. Particularly after neutralization, the polymers offer advantageous properties compared with polymers constituted by the same monomers but prepared by direct reverse emulsion polymerization with higher degrees of neutralization and/or with a different total concentration of monomers.

After complete neutralization of the free acid functions present, or at least after more substantial neutralization, the polymers used in the context of the invention can advantageously be used to thicken aqueous media present in detergent compositions much more efficiently.

The detergent compositions in accordance with the invention and their preparation process, and in particular the incorporation of the polymers described above, are described below in detail.

The manufacture of detergent compositions is well known to the person skilled in the art. It generally consists in adding, in succession, one or more cleaning surfactants and other ingredients such as additives to an aqueous solution.

The thickening acrylic polymer described above may be added at any step in the manufacture of the detergent composition. The detergent composition preferably comprises 0.01% to 10% by weight of thickening acrylic polymer described above, and preferably 0.1% to 5% by weight, these percentages being given relative to the total composition weight.

The neutralization step resulting in a percentage of neutralized acid functions of 30% to 100% relative to the totality of the acid functions present on the polymer may be carried out before or after incorporating the polymer into the composition.

Furthermore, the advantageous properties of the polymer obtained by reverse emulsion polymerization in accordance with the process described above retains its advantageous properties whether it is in the form of a reverse emulsion of greater or lesser concentration, a powder, or an aqueous solution. As a result, the thickening polymer in accordance with the invention can be introduced into the detergent composition in the form of a reverse emulsion, a powder, or in the dissolved form, for example in water or in an organic solvent, or indeed in the form of an aqueous or organic dispersion. In general, a form of the polymer that is dissolved in water is introduced into the resulting composition either by reversal of a reverse emulsion in water, or by dissolving a powder in water. Irrespective of the form in which it is introduced into the detergent composition at the moment of its use, the polymer should be in a solution or in an aqueous phase of a multi-phase composition in which it acts as a thickener and stabilizer.

The composition in accordance with the invention comprises a portion termed the aqueous portion composed of water and of hydrophilic compounds. The composition may be in the form of a single aqueous portion (solution or gel) constituting the totality of the composition, or an aqueous dispersion including solid particles such as mineral microparticles improving the cleaning properties. In the remainder of the description, the term "aqueous phase" is applied to the portion of the composition that comprises water and the hydrophilic components of the composition, and in particular the components that are soluble or miscible with water, even for monophase compositions, or even for compositions constituted exclusively by an aqueous phase of this type. In addition to water, the composition may include at least one hydrophilic organic solvent such as alcohols, and in particular linear or branched $C_1$-$C_6$ monoalcohols such as ethanol, tert-butanol, n-butanol, isopropanol, or n-propanol, and polyols such as glycerin, diglycerin, propylene glycol, sorbitol, pentylene glycol, and polyethylene glycols, or indeed glycol ethers, in particular $C_2$, and hydrophilic $C_2$-$C_4$ aldehydes. The aqueous phase may contain all of the ingredients that are conventionally used in a detergent composition and that are generally water-soluble. The detergent composition preferably contains 10% to 99% by weight of water, preferably more than 20% by weight, and most preferably 30% to 95% by weight, these percentages being given relative to the total composition weight.

The detergent composition may contain 1% to 50% by weight of hydrophilic organic solvent as described above. It may also contain 0.1% to 20% by weight of solid particles. Solid particles that may be mentioned by way of example are solid inorganic particles such as silica or titanium dioxide, solid organic particles such as certain polymers (polyhydroxybutyric, polycaprolactone, polyorthoester, polyanhydride), or capsules enclosing additives such as fragrance, a soap, a fabric softener, said particles generally being microparticulate or nano-particulate in size.

In the context of the invention, besides using the thickening acrylic polymer of the invention, the detergent compositions correspond to compositions that are traditionally used in this field. For more details, reference should be made to the documents FR 2 766 838, FR 2 744 131, EP 0 759 966 B1, U.S. Pat. No. 6,274,539, US 2006/0281660, U.S. Pat. No. 7,973,004 and GB 2 346 891, certain pertinent parts of which repeated below.

The composition may also advantageously comprise at least one surfactant. This surfactant may be selected from anionic, amphoteric, nonionic, and cationic surfactants or mixtures thereof. In particular, the composition should comprise a surfactant corresponding to a water-in-oil and/or an oil-in-water emulsifying agent, preferably selected from those mentioned above in the context of the process for the polymerization of the thickening acrylic polymer. In general, the composition comprises one or more cleaning surfactant(s).

Cleaning Surfactants

When the composition contains one or more cleaning surfactants, these typically represent 0.1% to 50% by weight, and preferably 1% to 30% by weight of the total composition weight. The cleaning surfactants that may be incorporated into the composition in accordance with the invention encompass a variety of nonionic, cationic, anionic, and zwitterionic surfactants such as those described in *Mc Cutcheon's detergents and emulsifiers,* North American Edition (1996), Allured Publishing Corporation, and in particular in the following documents: FR 2 766 838, FR 2 744 131, GB 2 346 891, US 2006 0281660, U.S. Pat. No. 6,274,539 and EP 0 759 966.

In particular, the compositions in accordance with the invention comprise one or more cleaning surfactants selected from anionic or nonionic surfactants. The composition may comprise only one or else a plurality of anionic or nonionic cleaning surfactants. The anionic or nonionic cleaning surfactants may be used in a quantity such that the total quantity of anionic surfactant(s) and/or nonionic surfactant(s) represents 0.1% to 50% by weight, and preferably 1% to 30% by weight of the total composition weight.

Examples of cleaning surfactants that may be mentioned are:

alkyl ester sulfonates with formula Ra-CH($SO_3$M)—CO-ORb, where Ra represents a $C_8$-$C_{20}$ alkyl group, preferably $C_{10}$-$C_{16}$, Rb represents a $C_1$-$C_6$ alkyl group, preferably $C_1$-$C_3$, and M represents an alkali metal cation (for example a sodium, potassium, or lithium cation), a substituted or unsubstituted ammonium (for example methyl-, dimethyl-, trimethyl-, tetramethylammonium, dimethylpiperidineium, etc.), or an alkanolamine derivative (for example monoethanolamine, diethanolamine, triethanolamine, etc.), for example methyl ester sulfonate salts;

alkylsulfates with formula $RcOSO_3M'$, where Rc represents a $C_{10}$-$C_{24}$ alkyl, alkenyl, or hydroxyalkyl group, preferably $C_{12}$-$C_{20}$ and more particularly $C_{12}$-$C_{18}$, and M' represents a hydrogen atom or a cation with the same definition as above for M, as well as their ethoxylated (EO) and/or propoxylated (PO) derivatives exhibiting an average of 0.5 to 10 motifs, preferably 0.5 to 3 EO and/or PO motifs; examples that may be mentioned are lauryl ether sulfate, and in particular sodium lauryl ether sulfate;

alkylamide sulfates with formula $RdCONHReOSO_3M''$, where Rd represents a $C_2$-$C_{22}$ alkyl group, preferably $C_6$-$C_{20}$, Re represents a $C_2$-$C_3$ alkyl group, and M" represents a hydrogen atom or a cation with the same definition as above for M, and their ethoxylated (EO) and/or propoxylated (PO) derivatives exhibiting an average of 0.5 to 60 EO and/or PO motifs;

saturated or unsaturated $C_8$-$C_{24}$ fatty acid salts, preferably $C_{14}$-$C_{20}$, in particular of the palmite or copra type, with a cation having the same definition as above for M;

$C_8$-$C_{20}$ alkylbenzenesulfonates (such as dodecylbenzene sulfonate, in particular in its ethanolate form), primary or secondary $C_8$-$C_{22}$ alkylsulfonates (such as lauryl sulfonate, and in particular sodium lauryl sulfonate), alkylglycerol sulfonates, sulfonated polycarboxylic acids described in GB 1 082 179, paraffin sulfonates, N-acyl N-alkyltaurates, alkylphosphates, isethionates, alkylsuccinates, alkyl sulfosuccinates, monoesters or diesters of sulfosuccinates, N-acylsarcosinates, alkylglycoside sulfates, polyethoxycarboxylates, with a cation with the same definition as above for M.

Examples of nonionic cleaning surfactants that may be mentioned are alkoxylated nonionic surfactants, and in particular:

polyoxyalkylenated alkylphenols (in particular polyethoxyethylenated, polyoxypropylenated or polyoxybutylenated) the alkyl substituent of which is $C_6$-$C_{12}$ and containing 5 to 25 oxyalkylene motifs; examples that may be mentioned are ethoxylated octylphenols marketed with the reference TRITON® X, and in particular X95, X-114, X-100 or X-102 from Rohm & Haas Co, ethoxylated nonylphenols marketed under the reference Surfonic® N from Texaco;

polyoxyalkylenated $C_8$-$C_{22}$ aliphatic alcohols containing 1 to 25 oxyalkylene motifs (in particular oxyethylene or oxypropylene); examples that may be mentioned are ethoxylated alcohols marketed under the brand name Lutensol® by BASF, TERGITOL® 15-S-9, TERGITOL® 24-L-6 NMW marketed by Union Carbide Corp., NEODOL® 45-9, NEODOL® 23-65, NEODOL® 45-7, NEODOL® 45-4 marketed by Shell Chemical Company, KYRO BOB marketed by The Procter & Gamble Company, SYMPERONIC® A3 to A9 from ICI, and PLURONIC® compounds marketed by BASF;

ethoxylated mono and diglycerides, in particular those marketed by Wico under the reference Varionic;

alkoxylated terpene hydrocarbons such as ethoxylated and/or propoxylated α- or β-pinenes containing 1 to 30 oxyethylene and/or oxypropylene motifs;

products resulting from the condensation of ethylene oxide or propylene oxide with propylene glycol, ethylene glycol, in particular with a molecular weight of the order of 2000 to 10000, such as PLURONIC® marketed by BASF;

products resulting from the condensation of ethylene oxide or propylene oxide with ethylenediamine, such as TETRONIC® marketed by BASF;

ethoxylated and/or propoxylated $C_8$-$C_{18}$ fatty acids containing 5 to 25 ethoxylated and/or propoxylated motifs;

ethoxylated fatty amides containing 5 to 30 ethoxylated motifs;

ethoxylated amines containing 5 to 30 ethoxylated motifs;

alkoxylated amidoamines containing 1 to 50, preferably 1 to 25, more particularly 2 to 20 oxyalkylene motifs (preferably oxyethylene); and alkylpolyglycosides such as alkylpolyglucosides, in particular those marketed by SEPPIC under the reference Simulsol®.

By way of example, the nonionic surfactant(s) present in the compositions in accordance with the invention have an HLB value ("Hydrophilic-Lipophilic Balance") of 8 to 13 and, preferably, 9.5 to 11.

It is also possible to use other anionic or nonionic cleaning surfactant(s), in which the hydrophilic portion contains one or more saccharide motifs as described in the application FR 2 744 131, to which reference should be made for further details.

It is also possible for the detergent compositions to comprise one or more zwitterionic or cationic surfactants, instead of or in addition to such anionic or nonionic surfactants. This solution, however, is not preferred, because adding anionic acrylic thickening polymers to a composition containing cationic surfactants may result in incompatibility between species with opposing ionicities.

Examples of zwitterionic cleaning surfactants that may be mentioned are aliphatic $C_8$-$C_{18}$ compounds of quaternary ammonium, phosphonium and sulfonium, which carry a substituent containing an anionic group for dissolution in water such as a carboxy, a sulfonate, a sulfate, a phosphate, a phosphonate group, and analogs, alkyl aminosulfonates, alkylbetaines and alkylamidobetaines (for example, (coprayl)amidopropylbetaine), stearamidopropyldimethylamine, diethylaminoethylstearamide, dimethylstearamine, dimethylsoyamine, soyamine, myristylamine, tridecylamine, ethylstearylamine, N-tallowpropanediamine, ethoxylated stearylamine (5 moles of ethylene oxide), dihydroxyethylstearylamine, arachidylbehenylamine, and their analogs.

Examples of cationic cleaning surfactants that may be mentioned are quaternary ammonium salts containing three lower alkyl groups ($C_1$ to $C_4$) (preferably methyl groups) and one long-chain alkyl group ($C_8$ to $C_{20}$), for example (coprayl)trimethylammonium chloride; alkylpyridinium salts and other compounds in which the nitrogen atom of the pyridine takes a quaternary form, as an example as in an alkylpyridinium bromide, preferably with $C_{10}$ to $C_{20}$ alkyl chains, and preferably $C_{12}$ to $C_{18}$.

Detergent compositions in accordance with the invention also usually contain one or more additives selected from: detergent additives (also known as "builders"), anti-soiling agents, antiredeposition agents, bleaching agents, fluorescence agents (also known as optical brighteners), foam suppressing agents (also known as anti-foaming agents), enzymes, chelating agents, neutralizing agents, and pH-adjusting agents. In particular, detergent compositions in accordance with the invention should comprise at least one cleaning surfactant and at least one detergent additive (also known as "builders"), especially for compositions for cleaning dishes, for a dishwasher. Clearly, these additives need to be adapted by the person skilled in the art as a function of the envisaged application for the detergent composition.

Additives of this type are described in particular in Documents FR 2 766 838 and FR 2 744 131 and their description is repeated below:

Detergent Additives (Also Known as "Builders")

Detergent agents of this type, also known as "builders", are complexing agents for complexing ions in water that have a deleterious effect during cleaning, in particular in the case of cleaning with hard water. In particular, an agent of this type should be incorporated in compositions for the dishwasher for cleaning dishes.

The composition may comprise only one or else a plurality of detergent additive(s). The detergent additives may have a mineral or organic nature. They could be used in a quantity such that the total quantity of detergent additive(s) represents of the order of 5% to 50% by weight of the total composition weight. Examples of detergent additives that may be mentioned are:

- polyphosphates (tripolyphosphates, pyrophosphates, orthophosphates, hexametaphosphates) of alkali metals, ammonium, or alkanolamines;
- tetraborates or borate precursors;
- alkaline or alkaline-earth carbonates (bicarbonates, sesquicarbonates);
- the lamellar silicates described in patent U.S. Pat. No. 4,664,839;
- crystalline or amorphous aluminosilicates of alkali metals (sodium, potassium) or of ammonium, such as A, P, X zeolites;
- water-soluble polyphosphonates (ethane-1-hydroxy-1,1-diphosphonates, methylene diphosphonate salts, etc.);
- polycarboxylate ethers (oxydisuccinic acid and its salts, tartrate monosuccinic acid and its salts, tartrate disuccinic acid and its salts, etc.);
- hydroxypolycarboxylate ethers;
- citric acid, mellitic acid, succinic acid and their salts, for example sodium citrate;
- salts of polyacetic acids (ethylenediamine tetraacetates, nitrilotriacetates, S-(2 hydroxyethyl)-nitrilodiacetates, etc.);
- $C_5$-$C_{20}$ alkyl succinic acids and their salts (2-dodecenylsuccinates, laurylsuccinates, etc.);
- carboxylic polyacetal esters;
- polyaspartic acid, polyglutamic acid, and their salts;
- polyimides derived from the polycondensation of aspartic acid and/or glutamic acid;
- polycarboxymethyl derivatives of glutamic acid (such as N,N-bis(carboxymethyl)glutamic acid and its salts, in particular its sodium salt, etc.) or other amino acids;
- aminophosphonates such as nitrilotris (methylene phosphonates), and
- polyfunctional aromatic compounds such as dihydroxydisulfobenzenes.

Anti-soiling Agents

The composition may include one or more anti-soiling agent(s). They may be used in a quantity such that the total quantity of anti-soiling agent(s) represents 0.01% to 10%, in particular 0.2% to 3% by weight of the total composition weight. Examples of anti-soiling agents that may be mentioned are:

- cellulosic derivatives such as cellulose hydroxyethers, methylcellulose, ethylcellulose, hydroxypropyl methylcellulose, or hydroxybutyl methylcellulose;
- polyvinylesters grafted onto polyalkylene backbones such as polyvinylacetates grafted onto polyoxyethylene backbones (such as those described in particular in EP 0 219 048);
- polyvinyl alcohols;
- polyester copolymers based on ethylene terephthalate and/or propylene terephthalate and polyoxyethylene terephthalate motifs, with molar ratio: number of ethylene terephthalate and/or propylene terephthalate motifs/number of polyoxyethylene terephthalate motifs of 1/10 to 10/i, preferably 1/1 to 9/1, polyoxyethylene terephthalates containing polyoxyethylene units having a molecular weight of the order of 300 to 5000, preferably 600 to 5000 (as described in particular in U.S. Pat. Nos. 3,959,230, 3,893,929, 4,116,896, 4,702,857 and 4,770,666);
- sulfonated polyester oligomers obtained by sulfonation of an oligomer derived from ethoxylated allyl alcohol, dimethylterephthalate and 1,2-propylene diol, containing to 4 sulfone groups (as described in particular in U.S. Pat. No. 4,968,451);
- polyester copolymers based on propylene terephthalate and polyoxyethylene terephthalate motifs and terminated by ethyl or methyl motifs (as described in particular in U.S. Pat. No. 4,711,730), or polyester oligomers terminated by alkylpolyethoxy groups (as described in particular in U.S. Pat. No. 4,702,857), or anionic sulfopolyethoxy groups (as described in particular in U.S. Pat. No. 4,721,580) or sulfoaroyl groups (as described in particular in U.S. Pat. No. 4,877,896);
- sulfone polyesters with a number average molecular mass of less than 20 000, obtained from a terephthalic acid diester, a sulfoisophthalic acid diester and a diol (as described in particular in FR 2 720 400), and
- polyester-polyurethanes obtained by reaction of a polyester with a number average molecular mass of 300-4000 obtained from adipic acid and/or terephthalic acid and/or sulfoisophthalic acid and a diol, on a prepolymer containing terminal isocyanate groups obtained from a polyoxyethylene glycol with a molecular mass of 600-4000 and a diisocyanate (as described in particular in FR 2 334 698).

Anti-redeposition Agents

The composition may comprise only one or else a plurality of anti-redeposition agent(s). They may be used in a quantity such that the total quantity of anti-redeposition agent(s) represents 0.01% to 10%, in particular 0.01% to 5% by weight of the total composition weight. Examples of anti-redeposition agents that may be mentioned are:

- ethoxylated monoamines or polyamines, polymers of ethoxylated amines (as described in particular in U.S. Pat. No. 4,597,898 and EP 0 011 984);
- carboxymethylcellulose;
- sulfonated polyester oligomers obtained by condensation of isophthalic acid, dimethyl sulfosuccinate and diethylene glycol (as described in particular in FR 2 236 926), and
- polyvinylpyrrolidones.

Bleaching Agents

The composition may comprise only one or else a plurality of bleaching agent(s). They may be used in a quantity such that the total quantity of bleaching agent(s) represents 0.01% to 20%, in particular 1% to 10% by weight of the total composition weight. Examples of bleaching agents that may be mentioned are:

- perborates such as monohydrated or tetrahydrated sodium perborate;

chlorinated bleaching agents such as hypochlorites, in particular of an alkali metal, for example sodium hypochlorite (bleach), which also have a cleaning and disinfectant role;

peroxygenated compounds such as peroxyhydrated sodium carbonate, peroxyhydrated pyrophosphate, peroxyhydrated urea, sodium peroxide, sodium persulfate, diphthaloyl peroxide, and percarboxylic acids and their salts (known as "percarbonates"), such as hexahydrated magnesium monoperoxyphthalate, magnesium metachloroperbenzoate, 4-nonylamino-4-oxoperoxybutyric acid, 6-nonylamino-6-oxoperoxycaproic acid, diperoxydodecanedioic acid, the nonylamide of peroxysuccinic acid, decyldiperoxysuccinic acid, and phthalimidoperoxyhexanoic acid.

When the composition comprises only one or else a plurality of bleaching agent(s), it should preferably also include a bleach activator generating a carboxylic peroxyacid in situ in the detergent medium; activators that may be mentioned include tetraacetylethylene diamine, tetraacetyl methylene diamine, tetraacetyl glycoluryl, sodium p-acetoxybenzene sulfonate, glycerol trialkalates such as pentaacetyl glucose, and octaacetyl lactose, etc.

Fluorescence Agents

The composition may comprise only one or else a plurality of fluorescence agent(s), in particular when the composition is a washing composition for laundry. They may be used in a quantity such that the total quantity of fluorescence agent(s) represents 0.05% to 1.2%, by weight of the total composition weight. Examples of fluorescence agents that may be mentioned are: derivatives of stilbene, pyrazoline, coumarin, fumaric acid, cinnamic acid, azoles, methine, cyanines, thiophenes, etc.

Foam Suppressing Agents

The composition may comprise only one or else a plurality of foam suppressing agent(s), in particular when the composition is a washing composition for laundry. They may be used in a quantity such that the total quantity of foam suppressing agent(s) represents 0.01% to 5% by weight of the total composition weight. Examples of foam suppressing agents that may be mentioned are:

monocarboxylic $C_{10}$-$C_{24}$ fatty acids or their alkali salts, their ammonium or alkanolamine salts, or fatty acid triglycerides;

saturated or unsaturated aliphatic, alicyclic, aromatic or heterocyclic hydrocarbons, such as paraffins and waxes;

N-alkylaminotriazines;

monostearylphosphates, monostearyl alcohol phosphates; and polyorganosiloxane oils or resins, optionally combined with particles of silica.

Enzymes

The composition may comprise only one or else a plurality of enzyme(s), in particular when the composition is a composition for washing laundry. They may be used in a quantity such that the total quantity of enzyme(s) represents 0.005% to 0.5% by weight of the total composition weight. Examples of enzymes that may be mentioned are proteases (for example Alcalase or Savinase, marketed by Novo Nordisk), amylases, lipases, cellulases, and peroxidases.

Chelating Agents

Examples of chelating agents that may be incorporated into the composition that may be mentioned are EDTA (ethylenediaminetetraacetic acid) and salts thereof, such as disodium EDTA; cyclodextrins; and their analogs. When the composition contains one or more chelating agents, it(they) typically represent 0.001% to 3% by weight of the total composition weight, preferably 0.01% to 2% by weight, and more preferably 0.01% to 1% by weight of the total composition weight.

Thickening Polymers

One or more thickening polymers other than the acrylic polymers described above may also be incorporated into the detergent compositions in accordance with the invention. These polymers may be natural, semi-natural or synthetic polymers.

Examples of natural polymers that may be mentioned are chitins, chitosan and derivatives thereof, gum Arabic, agar, guar gum, carob bean gum, gum ghatti, karaya gum, xanthan gums, and alginates.

Examples of synthetic polymers that may be mentioned are polymers based on acrylamide, sodium acrylate, vinylpyrrolidone, and 2-acrylamido-2-methylpropane sulfonic acid, for example obtained by polymerization processes other than that described in the context of the invention, and in particular by precipitation polymerization.

Neutralizing Agents and pH Adjustment Agents

One or more neutralizing agents and/or one or more pH adjustment agents may be incorporated into the composition in order to bring the pH of the composition to the desired levels. Examples of neutralizing agents and pH adjustment agents that may be mentioned are triethanolamine, aminomethylpropanol, ammonium hydroxide, sodium hydroxide, other alkaline hydroxides, alkaline carbonates such as sodium carbonate, alkaline silicates such as sodium silicate, ascorbic acid and salts thereof, sorbic acid and salts thereof, phosphoric acid and salts thereof, citric acid and salts thereof, lactic acid and salts thereof, glycolic acid and salts thereof, boric acid and salts thereof, acetic acid and salts thereof, and their analogs. Preferably, the neutralizing agents and the pH-adjusting agent or agents are used in the composition of the invention in a quantity sufficient to provide a pH of 4 to 10. Preferably, the pH-adjusting agent(s) is(are) used in a quantity sufficient to provide the composition with a pH of 4.5 to 8, preferably 5 to 7.5.

The detergent compositions may also include other additives such as:

a softening agent such as clays, for example in a quantity such that the total quantity of softening agent(s) represents 0.5% to 10% by weight of the total composition weight;

a buffer or pH modifying agent;

a preservative;

a fragrance;

an opacifying agent;

a colorant;

a pearlizing agent, etc.

The examples below serve to illustrate the invention, but have no limiting character.

I. Examples of the Preparation of an Acrylic Acid/sodium Acrylate Homopolymer

EXAMPLE 1

The ingredients of the aqueous phase were placed in a 1 L beaker that was being magnetically stirred:

150 g glacial acrylic acid;

605 g deionized water;

0.023 g sodium hypophosphite (150 ppm/total monomer weight);

0.10 g sodium diethylenetriamine pentacetate;

0.075 g methylene bisacrylamide (500 ppm/total monomer weight);

0.15 g sodium bromate.

Next, the organic phase was prepared in a 1 L glass reactor with mechanical stirring, using:

102 g aliphatic hydrocarbon (Isopar L);

98 g white mineral oil (Marcol 152);

20 g sorbitol monooleate;

25 g polymeric stabilizer (Hypermer 1083).

The aqueous phase was slowly transferred into the organic phase. The pre-emulsion that was thus formed then underwent intense shear for 1 min (Ultra Turrax, IKA).

The reverse emulsion was then degassed for 30 min by simply bubbling nitrogen through.

An aqueous solution was then added containing 1.0% by weight of sodium metabisulfite at a flow rate of 2.5 mL/h over a period of 1 h30. Once the maximum temperature had been reached, the temperature of the reaction mixture was maintained for 60 min before cooling.

Finally, at about 30° C., 40 g of ethoxylated tridecyl alcohol was added (6 moles).

EXAMPLE 2

The ingredients of the aqueous phase were placed in a 1 L beaker that was being magnetically stirred:

175 g glacial acrylic acid;

580 g deionized water;

0.26 g sodium hypophosphite (150 ppm/total monomer weight);

0.10 g sodium diethylenetriamine pentacetate;

0.087 g methylene bisacrylamide (500 ppm/total monomer weight);

0.15 g sodium bromate;

Subsequently, in order to prepare the organic phase and to carry out the remainder of the preparation process, the procedure followed was that described in Example 1.

EXAMPLE 3

The ingredients of the aqueous phase were placed in a 1 L beaker that was being magnetically stirred:

100 g glacial acrylic acid;

655 g deionized water;

0.015 g sodium hypophosphite (150 ppm/total monomer weight);

0.10 g sodium diethylenetriamine pentacetate;

0.05 g methylene bisacrylamide (500 ppm/total monomer weight);

0.15 g sodium bromate;

Subsequently, in order to prepare the organic phase and to carry out the remainder of the preparation process, the procedure followed was that described in Example 1.

EXAMPLE 4

Neutralization 3.5%/concentration 2.76

The same process as that described in Example 1 was carried out, adding 5.83 g of 50% sodium hydroxide solution to the aqueous phase, keeping the weight of the aqueous phase the same by adjusting the quantity of deionized water.

EXAMPLE 5

Neutralization 19%/concentration 3.5

The ingredients of the aqueous phase were placed in a 1 L beaker that was being magnetically stirred:

190 g glacial acrylic acid;

40 g of 50% sodium hydroxide solution;

525 g deionized water;

0.028 g sodium hypophosphite (150 ppm/total monomer weight);

0.10 g sodium diethylenetriamine pentacetate;

0.095 g methylene bisacrylamide (500 ppm/total monomer weight);

0.15 g sodium bromate.

Subsequently, in order to prepare the organic phase and to carry out the remainder of the preparation process, the procedure followed was that described in Example 1.

COMPARATIVE EXAMPLE 1

The ingredients of the aqueous phase were placed in a 1 L beaker that was being magnetically stirred:

50 g glacial acrylic acid;

705 g deionized water;

0.075 g sodium hypophosphite (150 ppm/total monomer weight);

0.10 g sodium diethylenetriamine pentacetate;

0.043 g methylene bisacrylamide (860 ppm/total monomer weight);

0.15 g sodium bromate.

Subsequently, in order to prepare the organic phase and to carry out the remainder of the preparation process, the procedure followed was that described in Example 1.

COMPARATIVE EXAMPLE 2

The ingredients of the aqueous phase were placed in a 1 L beaker that was being magnetically stirred:

199 g glacial acrylic acid;

115 g of 50% sodium hydroxide solution;

441 g deionized water;

0.03 g sodium hypophosphite (150 ppm/total monomer weight);

0.10 g sodium diethylenetriamine pentacetate;

0.15 g methylene bisacrylamide (750 ppm/total monomer weight);

0.15 g sodium bromate.

Subsequently, in order to prepare the organic phase and to carry out the remainder of the preparation process, the procedure followed was that described in Example 1.

COMPARATIVE EXAMPLE 3

The ingredients of the aqueous phase were placed in a 1 L beaker that was being magnetically stirred:

199 g glacial acrylic acid;

556 g deionized water;

0.03 g sodium hypophosphite (150 ppm/total monomer weight);

0.10 g sodium diethylenetriamine pentacetate;

0.1 g methylene bisacrylamide (500 ppm/total monomer weight);

0.15 g sodium bromate.

Subsequently, in order to prepare the organic phase, the procedure described in Example 1 was followed.

The aqueous phase was slowly transferred into the organic phase. The pre-emulsion that was thus formed then underwent intense shear for 1 min (Ultra Turrax, IKA).

The reverse emulsion was then degassed for 30 minutes by simply bubbling nitrogen through.

An aqueous solution containing 1.0% by weight of sodium metabisulfite was then added at a flow rate of 2.5 mL/h. Immediately after starting to add this reducing solution, the emulsion destabilized and then coagulated. Polymerization was impossible since the system was not stable.

COMPARATIVE EXAMPLE 4

The ingredients of the aqueous phase were placed in a 1 L beaker that was being magnetically stirred:

150 g glacial acrylic acid;

83 g of 50% sodium hydroxide solution;

522 g deionized water;

0.023 g sodium hypophosphite (150 ppm/total monomer weight);

0.10 g sodium diethylenetriamine pentacetate;

0.75 g methylene bisacrylamide (500 ppm/total monomer weight);

0.15 g sodium bromate.

Subsequently, in order to prepare the organic phase and to carry out the remainder of the preparation process, the procedure followed was that described in Example 1.

Characterization of Polymers

Procedure: Measurement of the viscosity of the aqueous solution of polymer at iso-concentration [0.16% by weight].

250 g of deionized water was introduced into a 400 mL beaker then, with mechanical stirring (triple-bladed mixer—500 rpm), was slowly added the desired quantity of reverse emulsion for obtaining a solution containing 0.16% by weight of thickening polymer. The pH was then adjusted to 7±0.1 with sodium hydroxide. At this pH, 100% of the acid functions present on the polymer were neutralized. The solution was left for 15 min with stirring, then allowed to stand for 5 min. The viscosity was then measured with the aid of a type RVT Brookfield viscosimeter using spindle 4 and with a speed of rotation of 20 rpm.

The results are shown in Table 1.

TABLE 1

| Example | NAF | MC | Viscosity 0.16% in water (cps) |
|---|---|---|---|
| 1 | 0% | 2.8 | 6500 |
| 2 | 0% | 3.2 | 4000 |
| 3 | 0% | 1.8 | 6200 |
| 4 | 3.5% | 2.8 | 6500 |
| 5 | 19% | 3.5 | 2500 |
| Comparative 1 | 0% | 0.9 | 1700 |
| Comparative 2 | 52% | 3.7 | 500 |
| Comparative 3 | 0% | 3.7 | Emulsion not stable |
| Comparative 4 | 50% | 2.8 | 1500 |

NAF: Neutralization of the acid functions (%) at the end of polymerization.

MC: Monomer concentration in mmol/g of aqueous phase.

The polymers used in the context of the invention obtained by the reverse emulsion polymerization process had a much better thickening effect than polymers obtained by reverse emulsion processes not complying with the conditions for the % neutralization before polymerization and monomer concentration.

The polymers obtained in accordance with the invention were highly efficient at very low concentration.

The resistance to surfactants was evaluated by using these very polymers in deionized water and in the presence of a surfactant: sodium lauryl ether sulfate (LES), marketed by BASF under the reference Texapon® NSO.

The polymers were compared with one another and with other commercially available thickening polymers: Acusol®820 (Rhom & Haas), an anionic copolymer based on ethyl acrylate and acrylic acid and containing a hydrophobic monomer, obtained by emulsion polymerization (not reverse), and Carbopol° 676 (Lubrizol), a cross-linked acrylic acid polymer obtained by precipitation polymerization. These commercial products are typically used in detergent compositions as a thickening agent.

The change in the viscosity of a solution comprising 1% by weight of thickening polymer was studied as a function of the conversion of LES.

More precisely, 250 g of deionized water was introduced into a 400 mL beaker then, with mechanical stirring (triple-bladed mixer—500 rpm), the quantity of reverse emulsion required to obtain a solution containing 1% by weight of thickening polymer was slowly added. The pH was then adjusted to 7 ±0.1 with sodium hydroxide. At this pH, 100% of the acid functions present on the polymer were neutralized. The LES was added at the desired concentration. The solution was left for 15 minutes with stirring, then left to stand for 5 minutes. The viscosity was then measured with the aid of a type RVT Brookfield viscosimeter with spindle 4 and a speed of rotation of 20 rpm.

The results obtained as a function of the % by weight of added LES are shown in Table 2.

TABLE 2

Measurement of viscosity of a solution containing 1% by weight of polymer with added sodium lauryl ether sulfate (LES)

| Ex | NAF (%) | MC (mmol/g) | Viscosity (cps) 0% LES | 5% LES | 10% LES | 20% LES |
|---|---|---|---|---|---|---|
| 1 | 0% | 2.8 | 21000 | 12500 | 8500 | 3000 |
| 2 | 0% | 3.2 | 18000 | 9000 | 5500 | 2000 |
| 3 | 0% | 1.8 | 19500 | 12500 | 8000 | 2500 |
| 4 | 3.5% | 2.8 | 21500 | 13000 | 9000 | 3000 |
| 5 | 19% | 3.5 | 25000 | 13000 | 7800 | 3500 |
| Comp.1 | 0% | 0.9 | 15000 | 3800 | 1400 | 150 |
| Comp.2 | 52% | 3.7 | 32000 | 5500 | 450 | 50 |
| Comp.3 | 0% | 3.7 | NA | NA | NA | NA |
| Comp.4 | 50% | 2.8 | 20000 | 3800 | 1000 | 150 |
| Carbopol ® 676 | NA, polymerization method different | | 46500 | 18500 | 9000 | 2500 |
| Acusol ® 820 | NA, polymerization method different | | 8000 | 400 | <10 | <10 |

NAF: Neutralization of the acid functions (%) at the end of polymerization.

MC: Monomer concentration in mmol/g of aqueous phase.

TABLE 3

Percentage drop in viscosity with the addition of sodium lauryl ether sulfate (LES).

| Ex | 5% LES | 10% LES | 20% LES |
|---|---|---|---|
| 1 | −40% | −60% | −85% |
| 2 | −50% | −69% | −89% |
| 3 | −36% | −56% | −87% |
| 4 | −40% | −58% | −86% |
| 5 | −48% | −69% | −86% |
| Comp. 1 | −75% | −91% | −99% |
| Comp. 2 | −83% | −98% | −99% |
| Comp. 3 | NA | NA | NA |
| Comp. 4 | −81% | −95% | −99% |
| Carbopol ® 676 | −60% | −81% | −95% |
| Acusol ® 820 | −95% | −99% | −99% |

The percentage drop in viscosity corresponds to the ratio between the viscosity termed the initial viscosity of the thickened solution without adding the surfactant minus the viscosity of the solution with added surfactant over the initial viscosity multiplied by 100.

The polymers of Examples 1 to 5 could produce a smaller drop in viscosity and thus good resistance to surfactants compared with the polymers of the comparative Examples 1 to 4 and with Carbopol® 676 and Acusol® 820.

The person skilled in the art can readily find the best compromise between the thickening efficiency and the surfactant resistance by using his knowledge to vary the polymerization parameters.

II—Behavior of Polymers in the Presence of a Variety of Surfactants

The series of tests below consisted in evaluating the viscosity of the solutions of the polymers in accordance with the invention in the presence of a variety of surfactants in routine use in detergent compositions. The same procedure as that which produced the results of Table 2 was carried out. The % by weight of each of the surfactants was 5% (relative to the total weight of the solution).

TABLE 4

Measurement of the viscosity of a solution containing 1% by weight of polymer with the addition of 5% by weight of various surfactants.

| Ex | Sodium lauryl ether sulfate | Simulsol SL 8 (SEPPIC-alkylpoly-glucoside) | Sodium lauryl sulfonate | Sodium dodecyl benzene sulfonate | Lutensol TO 89 (ethoxylated alcohol) | Alpha-step MC-48 (Stepan-sodium methylester sulfonate) |
|---|---|---|---|---|---|---|
| 1 | 12500 | 18500 | 11000 | 12000 | 19500 | 12200 |
| 2 | 9000 | 15500 | 8700 | 8800 | 16500 | 9000 |
| 3 | 12500 | 17500 | 10500 | 11800 | 17500 | 12000 |
| 4 | 13000 | 18500 | 10500 | 11000 | 19000 | 11800 |
| 5 | 13000 | 22000 | 11500 | 12000 | 21500 | 12000 |
| Comp. 1 | 3800 | 10000 | 3000 | 3300 | 11000 | 3500 |
| Comp. 2 | 5500 | 24000 | 5000 | 5000 | 25000 | 5200 |
| Comp. 3 | NA | NA | NA | NA | NA | NA |
| Comp. 4 | 3800 | 15000 | 2900 | 3200 | 14500 | 3400 |
| Carbopol ® 676 | 18500 | 36000 | 17000 | 17500 | 37000 | 17500 |
| Acusol ® 820 | 400 | 5700 | 300 | 350 | 5500 | 400 |

The percentage drop in viscosity corresponds to the ratio between the viscosity termed the initial viscosity of the thickened solution without added surfactant minus the viscosity of the solution with added surfactant, over the initial viscosity multiplied by 100.

TABLE 5

Percentage drop in viscosity with the addition of 5% by weight of various surfactants.

| Ex | Sodium lauryl ether sulfate | Simulsol SL 8 (SEPPIC-alkylpoly-glucoside) | Sodium lauryl sulfonate | Sodium dodecyl benzene sulfonate | Lutensol TO 89 (ethoxylated alcohol) | Alpha-step MC-48 (Stepan-sodium methylester sulfonate |
|---|---|---|---|---|---|---|
| 1 | −40% | −12% | −48% | −43% | −10% | −42% |
| 2 | −50% | −14% | −52% | −52% | −11% | −50% |
| 3 | −36% | −10% | −46% | −39% | −10% | −38% |
| 4 | −40% | −14% | −51% | −48% | −12% | −45% |
| 5 | −48% | −12% | −54% | −52% | −14% | −52% |
| Comp. 1 | −75% | −33% | −80% | −78% | −27% | −77% |
| Comp. 2 | −83% | −25% | −84% | −84% | −22% | −84% |
| Comp. 3 | NA | NA | NA | NA | NA | NA |
| Comp. 4 | −81% | −25% | −86% | −84% | −22% | −83% |
| Carbopol ® 676 | −60% | −23% | −63% | −62% | −20% | −62% |
| Acusol ® 820 | −95% | −29% | −96% | −96% | −31% | −95% |

The polymers of Examples 1 to 5 could produce a very good surfactant resistance compared with the polymers of the comparative Examples 1 to 4 and with Carbopol® 676 and Acusol® 820, even with different surfactants.

III—Efficiency in Detergent Compositions

The following tests show the advantage of using polymers obtained under concentration and % neutralization conditions defined in the context of the invention in detergent compositions. Polymers of this type provide the compositions with good thickening properties and good resistance to the presence of surfactants.

A laundry detergent was formulated with the reverse emulsion of Example 1 or with Acusol® 820, the market reference for this type of formulation.

A dishwasher detergent product was formulated with the reverse emulsion of Example 3 and with Carbopol® 676, market reference in this type of formulation. For each of the compositions numbered 1 and 2 below, the preparation protocol applied was as follows:

Composition No 1: Laundry Detergent

This formulation corresponded to a base liquid laundry detergent the viscosity of which was controlled by means of the presence of an acrylic polymer. The dosage was adjusted in order to obtain a viscosity of 800 centipoise (cps)±200 cps (Brookfield RVT, 20 rpm, spindle 3)

The preparation procedure was simple, consisting in adding all of the ingredients of the following formulation, in the order presented in Table 6 below, to a 400 mL beaker in order to obtain 250 g of final solution:

TABLE 6

| Ingredients | % by weight | Remarks |
|---|---|---|
| Deionized water | QCP 100% | Start at 70% and adjust at end of process. Stirring, triple-bladed mixer, 250 rpm |
| Sodium citrate | 3.0% | Wait for complete dissolution |

TABLE 6-continued

| Ingredients | % by weight | Remarks |
|---|---|---|
| Sodium dodecylbenzene sulfonate(surfactant) | 10.0% | Leave solution 15 min with stirring |
| Tridececylic alcohol 6 EO (surfactant) | 3.0% | |
| Sodium laureth sulfate 1EO (surfactant) | 10% | |
| NaOH (50% aqueous solution) | [11.0-12.0] | Add quantity necessary to adjust pH to within indicated range |
| Acrylic polymer * | X % | Quantity to obtain desired viscosity |
| Sodium carbonate | 1.0% | Wait for complete dissolution |
| Fragrance and colorants | 0.25% | |

*The acrylic polymers tested were as follows:

| Acrylic polymer * | Example 1 | Acusol ® 820 |
|---|---|---|
| Dosage as % by weight of reverse emulsion as prepared or sold commercially | 1.8 | 7 |
| % by weight of thickening polymer in reverse emulsion as prepared (Ex 1) or sold commercially (Acusol ® 820) | 50% | 30% |
| % by weight of polymer in composition | 0.9 | 2.1 |
| Final viscosity (cps) | 800 | 800 |
| Comments | Rapid dispersion of polymer (<3 min) Increase in viscosity without forming agglomerates | Rapid dispersion |

The polymer of Example 1 could be used to thicken the laundry detergent formulation for laundry containing 23% of surfactant much more effectively compared with Acusol® 820.

Composition No 2: Liquid Product for Dishwasher

This formulation corresponded to an opaque liquid "gel" with added bleach for a washing machine, the viscosity of which was controlled by means of the presence of an acrylic polymer. The dosage was adjusted in order to obtain a viscosity of 9000 cps±2000 cps (Brookfield RVT, 20 rpm, spindle 6)

The preparation procedure was simple, consisting in adding all of the ingredients of the following formulation to a 400 mL in the order shown in Table 7 below in order to obtain 250 g of final solution:

TABLE 7

| Ingredients | % by weight | Remarks |
|---|---|---|
| Deionized water | QCP 100% | Start at 50% and adjust at end of procedure. Stirring, triple-bladed mixer, 500 rpm |
| Acrylic polymer * | 3.0% | Mix for approximately 30 min |
| Sodium carbonate | 10.0% | Add slowly at 250 rpm. |
| Sodium silicate | 13.0% | Leave solution 15 minutes with stirring |
| NaOH (50%) | 5% | Quantity to obtain a pH in the range 12.0-13.0 |
| Sodium tripolyphosphate | 15% | Add slowly and stir until powder completely dissolved |
| Sodium lauryl sulfate (surfactant) | 3% | Add slowly and stir for 5 minutes |
| Sodium hypochlorite (12.5% by weight in aqueous solution) | 8% | Cool viscous solution to a temperature < 30° C. then add bleach. Stir for 15 minutes |

*The acrylic polymers that were tested were as follows:

| Acrylic polymer * | Example 3 | Carbopol ® 676 |
|---|---|---|
| Dosage as % by weight of reverse emulsion as prepared (Ex 3) or powder (Carbopol ® 676) | 1.6 | 0.9 |
| % by weight of thickening polymer in reverse emulsion as prepared (Ex 3) or sold commercially (Carbopol ® 676) | 50% | 100% |
| % by weight of polymer in the composition | 0.8 | 0.9 |
| Final viscosity (cps) | 9000 | 8900 |
| Comments | Complete dispersion after minimum of 30 min of stirring | |

The polymer of Example 3 was capable of thickening the laundry detergent formulation containing 3% of surfactant much more effectively compared with Carbopol® 676.

The invention claimed is:

1. A method for preparing an aqueous liquid detergent composition for household or industrial use, wherein said composition comprises a branched or cross-linked polymer composed by repeating one or more monomeric units, with at least one of the monomeric units corresponding to a monomer comprising an acrylic group and at least 30 mol % of the monomeric units carrying at least one weak acid function that is optionally in neutralized form, the method comprising obtaining said polymer:

by polymerizing an aqueous solution of one or more monomers by water-in-oil reverse emulsion, at least one of the monomers used being an acrylic monomer and one or more of the monomers used being a monomer carrying at least one weak acid function, the molar percentage of monomers carrying at least one weak acid function relative to the totality of the monomers used being at least 30%, the aqueous phase containing at least one monomer acting as a branching agent, in a manner such that the polymerization results in a branched or cross-linked polymer, wherein:

i) the polymerization is carried out with a total concentration of the monomers in aqueous solution being in the range 1.3 mmol to 3.6 mmol per gram of aqueous solution; and ii) during the polymerization, at most 20% of the acid functions present on the monomers having at least one acid function are in the neutralized form.

2. A method for thickening an aqueous liquid detergent composition for household or industrial use, wherein said composition comprises a branched or cross-linked polymer composed by repeating one or more monomeric units, with at least one of the monomeric units corresponding to a monomer comprising an acrylic group and at least 30 mol % of the monomeric units carrying at least one weak acid function that is optionally in neutralized form, the method comprising obtaining said polymer:

by polymerizing an aqueous solution of one or more monomers by water-in-oil reverse emulsion, at least one of the monomers used being an acrylic monomer and one or more of the monomers used being a monomer carrying at least one weak acid function, the molar percentage of monomers carrying at least one weak acid function relative to the totality of the monomers used being at least 30%, the aqueous phase containing at least one monomer acting as a branching agent, in a manner such that the polymerization results in a branched or cross-linked polymer, wherein:

i) the polymerization is carried out with a total concentration of the monomers in aqueous solution being in the range 1.3 mmol to 3.6 mmol per gram of aqueous solution; and ii) during the polymerization, at most 20% of the acid functions present on the monomers having at least one acid function are in the neutralized form, and using said polymer to thicken the aqueous liquid detergent composition.

3. The method according to claim 1, wherein the polymer comprises a percentage of neutralized acid functions of 30% to 100% relative to the totality of acid functions present on the polymer, obtained by a step of at least partial neutralization of the acid functions present on the polymer produced after the polymerization and before or after preparation of the composition.

4. An aqueous liquid detergent composition for household or industrial use, comprising at least one branched or cross-linked polymer composed by repeating one or more monomeric units, with at least one of the monomeric units corresponding to a monomer having an acrylic group and at least 30 mol % of the monomeric units carrying at least one weak acid function being at least partially in the neutralized form, the percentage of neutralized acid functions relative to the totality of the acid functions present on the polymer being 30% to 100%, said polymer being obtained:

by polymerizing an aqueous solution of one or more monomers by water-in-oil reverse emulsion, at least one of the monomers used being an acrylic monomer and one or more of the monomers used being a monomer carrying at least one weak acid function, the molar percentage of monomers carrying at least one weak acid function relative to the totality of the monomers used being at least 30%, the aqueous phase containing at least one monomer acting as a branching agent, in a manner such that the polymerization results in a branched or cross-linked polymer, wherein:

i) the polymerization is carried out with a total concentration of the monomers in aqueous solution being in the range 1.3 mmol to 3.6 mmol per gram of aqueous solution; and ii) during the polymerization, at most 20% of the acid functions present on the monomers having at least one acid function are in the neutralized form;

the polymerization being followed by a step of at least partial neutralization of the acid functions, carried out before or after incorporating the polymer into the composition.

5. A method of washing clothes by hand or in a washing machine or cleaning a hard surface selected from a dish, furniture, floor, window glass, wood, and metal, the method comprising washing the clothes or cleaning the hard surface with the aqueous liquid detergent composition according to claim 4.

6. The aqueous liquid detergent composition according to claim 4, wherein during the polymerization, at most 10% of the acid functions present on the monomers having at least one acid function are in the neutralized form.

7. The aqueous liquid detergent composition according to claim 4, wherein all of the acid functions present on the monomers are in the free acid form during the polymerization.

8. The aqueous liquid detergent composition according to claim 4, wherein the polymerization is carried out with a total concentration of the monomers in aqueous solution in the range 1.7 mmol to 3.3 mmol per gram of aqueous solution.

9. The aqueous liquid detergent composition according to claim 4, wherein the polymer comprises a molar percentage of monomeric units carrying one or more weak acid function(s), relative to the totality of the monomeric units carrying an acid function of at least 50%.

10. The aqueous liquid detergent composition according to claim 4, wherein the monomeric unit(s) carrying at least one weak acid function in the free form, is(are) selected from acrylic acid, methacrylic acid, itaconic acid, crotonic acid, maleic acid and fumaric acid.

11. The aqueous liquid detergent composition according to claim 4, wherein the polymer is a copolymer comprising at least one neutral monomeric unit selected from acrylamide, methacrylamide, N,N-dimethylacrylamide, N-vinylmethylacetamide, N-vinylformamide, vinyl acetate, diacetone acrylamide, N-isopropyl acrylamide, N-[2-hydroxy-1, 1bis (hydroxymethyl) ethyl] propenamide, (2-hydroxyethyl) acrylate, (2,3-dihydroxypropyl) acrylate, methyl methacrylate, (2-hydroxyethyl) methacrylate, (2,3 dihydroxypropyl) methacrylate and vinylpyrrolidone.

12. The aqueous liquid detergent composition according to claim 4, wherein the polymer is a copolymer comprising at least one monomeric unit carrying one or more strong acid function(s).

13. The aqueous liquid detergent composition according to claim 12, wherein the molar percentage of monomeric units carrying one or more strong acid function(s) relative to the totality of the monomeric units is less than 30%.

14. The aqueous liquid detergent composition according to claim 12, wherein the monomeric unit(s) carrying one or more strong acid function(s), in the free form, is(are) selected from acrylamidoalkylsulfonic acids.

15. The aqueous liquid detergent composition according to claim 4, wherein the branching agent is selected from methylene bisacrylamide (MBA), ethylene glycol di acrylate, polyethylene glycol dimethacrylate, diacrylamide, cyanomethylacrylate, vinyloxyethylacrylate, vinyloxymethacrylate, triallylamine, formaldehyde, glyoxal, glycidyl ethers, epoxies, and mixtures thereof.

16. The aqueous liquid detergent composition according to claim 4, wherein the quantity of branching agent is between 5 ppm and 10000 ppm by weight relative to the total weight of the monomers.

17. The aqueous liquid detergent composition according to claim 4, wherein the polymerization is carried out with a transfer agent selected from methanol, isopropyl alcohol, sodium hypophosphite, 2-mercaptoethanol, sodium methallylsulfonate, and mixtures thereof.

18. The aqueous liquid detergent composition according to claim 17, wherein the quantity of transfer agent is between 10 ppm and 5000 ppm by weight relative to the total weight of the monomers.

19. The aqueous liquid detergent composition according to claim 4, wherein the polymerization is followed by one or more of the following steps:

dilution or concentration of the emulsion obtained;

isolation in order to obtain the polymer in the form of a powder.

20. The aqueous liquid detergent composition according to claim 4, wherein the composition comprises 0.01% to 10% by weight of branched or cross-linked acrylic polymer relative to the total weight of the composition.

21. The aqueous liquid detergent composition according to claim 4, wherein the composition comprises one or more surfactants.

22. The aqueous liquid detergent composition according to claim 21, wherein the composition comprises 1% to 30% by weight of surfactant(s) selected from anionic and nonionic cleaning surfactants.

23. The aqueous liquid detergent composition according to claim 4, wherein the composition comprises at least one additive selected from: detergent additives, anti-soiling agents, antiredeposition agents, bleaching agents, fluorescence agents, foam suppressing agents, enzymes, chelating agents, neutralizing agents and pH-adjusting agents.

24. The aqueous liquid detergent composition according to claim 4, wherein the branched or cross-linked polymer is water-soluble or water-swellable.

* * * * *